US008082605B2

(12) United States Patent
Andreiu

(10) Patent No.: US 8,082,605 B2
(45) **Date of Patent: *Dec. 27, 2011**

(54) LOW FLOW HYGIENIC APPARATUS AND METHODS

(76) Inventor: Dan Marius Andreiu, Redondo Beach, CA (US)

( * ) Notice: Subject to any disclaimer, the term of this patent is extended or adjusted under 35 U.S.C. 154(b) by 1114 days.

This patent is subject to a terminal disclaimer.

(21) Appl. No.: 11/652,160

(22) Filed: Jan. 10, 2007

(65) Prior Publication Data

US 2008/0060122 A1 Mar. 13, 2008

Related U.S. Application Data

(63) Continuation-in-part of application No. 11/517,761, filed on Sep. 8, 2006.

(51) Int. Cl.
*E03D 1/00* (2006.01)
*E03D 3/00* (2006.01)
*E03D 5/00* (2006.01)

(52) U.S. Cl. ..... 4/300; 4/345; 4/428; 4/425; 4/421

(58) Field of Classification Search ..... 4/345, 428, 4/425, 421, 351, 424
See application file for complete search history.

(56) References Cited

U.S. PATENT DOCUMENTS

| | | | | | |
|---|---|---|---|---|---|
| 381,660 | A * | 4/1888 | Wells | 4/424 |
| 725,268 | A * | 4/1903 | Miller | 4/345 |
| 3,224,013 | A * | 12/1965 | Tubbs | 4/425 |
| 5,073,994 | A * | 12/1991 | Sargent et al. | 4/332 |
| 5,305,475 | A | 4/1994 | Jaeckels | |
| 5,502,845 | A * | 4/1996 | Hayashi et al. | 4/300 |
| 6,247,193 | B1 * | 6/2001 | Riepl | 4/420 |
| 6,804,840 | B2 * | 10/2004 | Berman | 4/434 |

FOREIGN PATENT DOCUMENTS

| | | | |
|---|---|---|---|
| JP | 06299587 | A2 | 10/1994 |
| KR | 102004097025 | A | 11/2004 |
| KR | 102005102736 | A | 10/2005 |
| WO | WO 9805829 | A2 | 2/1998 |

* cited by examiner

*Primary Examiner* — Gregory Huson
*Assistant Examiner* — Lauren Heitzer
(74) *Attorney, Agent, or Firm* — Kenneth L. Green

(57) ABSTRACT

A low volume hygienic apparatus used a high pressure spray to break up solid waste material in a containment chamber and to push liquid and broken-up solid waste from the containment chamber. A high pressure nozzle is pointed into the containment chamber and configured to break-up the solids using a prescribed pressure level and to propel the liquids and the broken-up solids from a chamber interior through a chamber outlet of the containment chamber. A completing structure is disposed between the chamber outlet and a drain and is configured to draw liquids and broken-up solids from the chamber at the end of a flushing cycle.

17 Claims, 11 Drawing Sheets

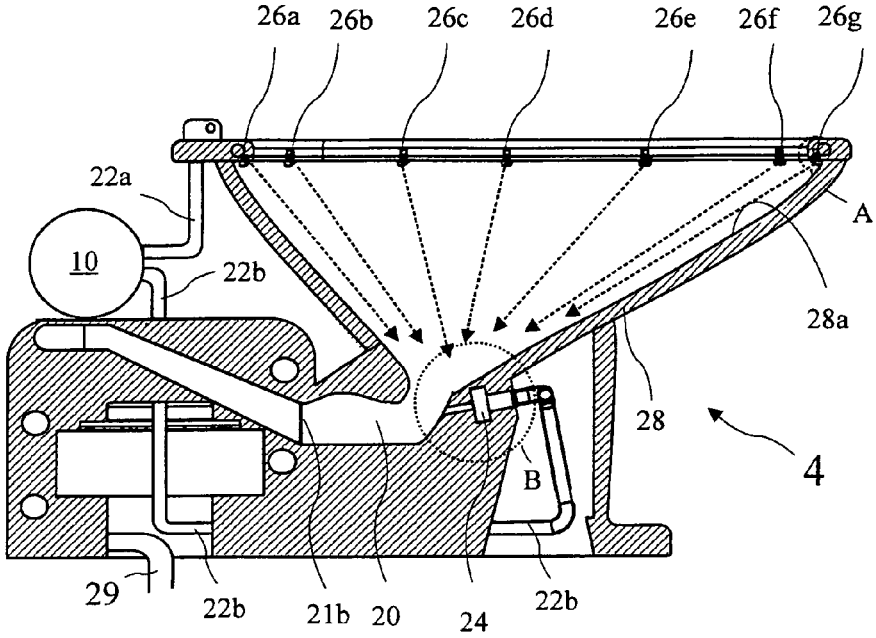
FIG. 6
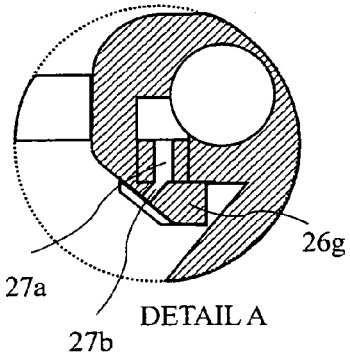
FIG. 7
FIG. 8
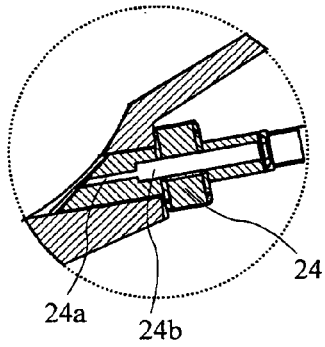
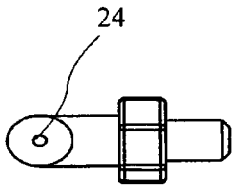
FIG. 9B
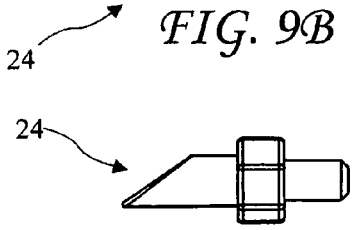
FIG. 9A
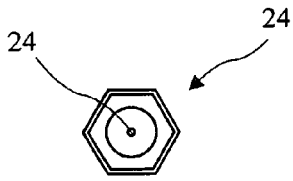
FIG. 9C

LOW FLOW HYGIENIC APPARATUS AND METHODS

The present application is a Continuation in Part of U.S. patent application Ser. No. 11/517,761, filed Sep. 8, 2006 for "LOW FLOW HYGIENIC APPARATUS AND METHODS", which application is incorporated herein by reference.

BACKGROUND OF THE INVENTION

The present invention relates to hygienic systems and more particularly to flushing apparatus having a high pressure nozzle to break up waste material and a velocity increasing structure to improve an outflow of waste material to lower an amount of wasted water required for flushing and to provide improved hygienic properties.

Conventional hygienic systems may be categorized in several varieties. In the United States, a standard toilet 2 (see FIG. 1) utilizes approximately three gallons of water per flush. Furthermore, known low flow water toilets utilizes approximately one and half gallons of water for a flush. These known toilets utilize a tank of water, e.g., a tank positioned above the toilet with a capacity between at least one-and-half gallons and more than three gallons, to release water from a relatively short vertical distance. During a toilet flush, water from the tank is released from a vertical distance less than one to two feet above a toilet bowl. In contrast to the standard toilet, European toilets utilize a tank mounted approximately six feet above the toilet bowl to increase its static head and resulting in a "cleaning force" due to gravity (i.e., conversion of the static head or potential energy to moving water with kinetic energy) but still require a substantial volume of water per flush.

In other words, know systems rely on gravity and a large volume of water to move solid and liquids in the toilet bowl through an outlet port, utilizing only a comparatively low-pressure flow. The low-pressure flow, in many instances, will not provide adequate clearing and/or cleaning of the toilet bowl and/or toilet channel when a large amount of liquid and/or solid mass becomes deposited and/or splashed inside the toilet bowl. Furthermore, when dropping solids into the toilet bowl or when flushing the system, solid and/or liquids may occasionally splash out of the bowl and possibly onto an individual using the toilet. Additionally, large solid masses may clog the toilet channel causing an overflow of the toilet bowl. Thus, these systems have a tendency to produce an unhygienic environment which may cause the spread of bacteria, and even illness, for individuals in proximity to or using the device, when dropping solids into static water.

Other problems with known systems include that water held in the tank required to operate the system is held by until needed, by a plunger, and/or other valve. The plunger connects or disconnect from a rubber seal. The rubber seal prevents water from leaking from the tank into the toilet bowl until manually, automatically, or semi-automatically opened. If the rubber seal becomes worn or damaged, which occurs during repeated movements of the plunger, the seal will leak. When leaking occurs, water is lost from the tank and replenished to maintain a defined level required for flushing the toilet. Thus, these systems (so-called "running toilets") waste water unless a perfect seal is maintained, and also may be annoying from the standpoint of creating unnecessary noise while periodically replenishing the tank. Such leaking rubber seal may not be problematic for a single isolated toilet, however, if several apartment buildings, hotels, manufacturing facilities, hospitals, etc. in the aggregate have hundreds of toilets, and if a number of the toilets are leaking water, the result is significant water waste.

Furthermore, these toilets require manual cleaning, e.g., utilizing a bristle brush and cleaner, because scale and/or waste products become deposited on the toilet bowl after multiple uses. The low flow toilets, such as one and half gallons as compared to three gallons flush standard toilet system, have similar or greater manual cleaning problems.

Another known toilet is a non-tank fed low flow toilet (e.g., 1.6 gallon) that directly connects to a standard water line and uses a mechanical system to control the amount if water for a single flush. However, this system is very noisy, subject to leakage, and its estimate of water may be inexact which results in water waste.

Finally, other electronically controlled toilet systems evidenced in the prior art have additional features such as heated seats, hot water cleaning, blow drying, reading lamps, etc., but do not address the need for a toilet having a very low flow water capability with a improved toilet bowl clearing and cleaning functionality.

Thus, apparatus and methods are needed for a hygienic system which overcomes the disadvantages of the known toilets described above. For instance, the proposed system needs, inter alia, increased reliability, e.g., minimize the need for a perfect seal, reduce or improve cleaning ability, reduce or minimize clogging of the toilet and ability for reduced water flush requirements as well as to provide additional advantages over conventional toilets.

BRIEF SUMMARY OF THE INVENTION

The present invention addresses the above and other needs by providing an improved flushing apparatus. In one aspect of the present invention, the apparatus includes a containment chamber including a chamber interior and an chamber outlet. A high pressure nozzle is disposed in the containment chamber to break-up the solids using a prescribed pressure level and to propel the liquids and the broken-up solids from the chamber interior through the chamber outlet.

In another aspect of the present invention, a flow completing structure is provided between the chamber output and a drain pipe. The flow completing structure comprises a length of tubing with a capacity sufficient to draw any remaining waste material from the containment chamber at the end of a flushing cycle. The flow completing structure may comprise a tubing coil housed in the device or a length of tubing inserted into the drain pipe.

In a third aspect of the invention, a method of operating the apparatus is disclosed. In one embodiment, the method comprises: depositing waste material comprising liquids and solids in a containment chamber; spraying a high pressure spray into the containment chamber to break up the solids; using the high pressure spray to push the liquid and broken up solids from the chamber to generate an outlet flow in a flow completing structure; and sufficiently containing the outlet flow in the flow completing structure to draw the remaining waste material from the chamber.

In a fourth aspect of the invention, a dolly useful for transporting the hygienic apparatus and a method of transporting the hygienic apparatus using the dolly is disclosed.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein:

FIG. 6 is a left side view of the hygienic apparatus in accordance with the present invention shown high pressure and low pressure nozzles.

FIG. 7 is a detail view of a low pressure rinsing nozzle used to wet a toilet bowl according to the present invention.

FIG. 8 is a detail view of a high pressure nozzle used to break-up solids and to push liquids and solids from the containment chamber according to the present invention FIG. 9A is a side view of the high pressure nozzle.

FIG. 9B is a top view of the high pressure nozzle.

FIG. 9C is a front view of the high pressure nozzle.

FIG. 9A is a side view of another hygienic apparatus in accordance with the present invention, including the second high pressure nozzle residing under the rim and providing the spiral flow in the bowl.

Corresponding reference characters indicate corresponding components throughout the several views of the drawings.

DETAILED DESCRIPTION OF THE INVENTION

Figure 1:
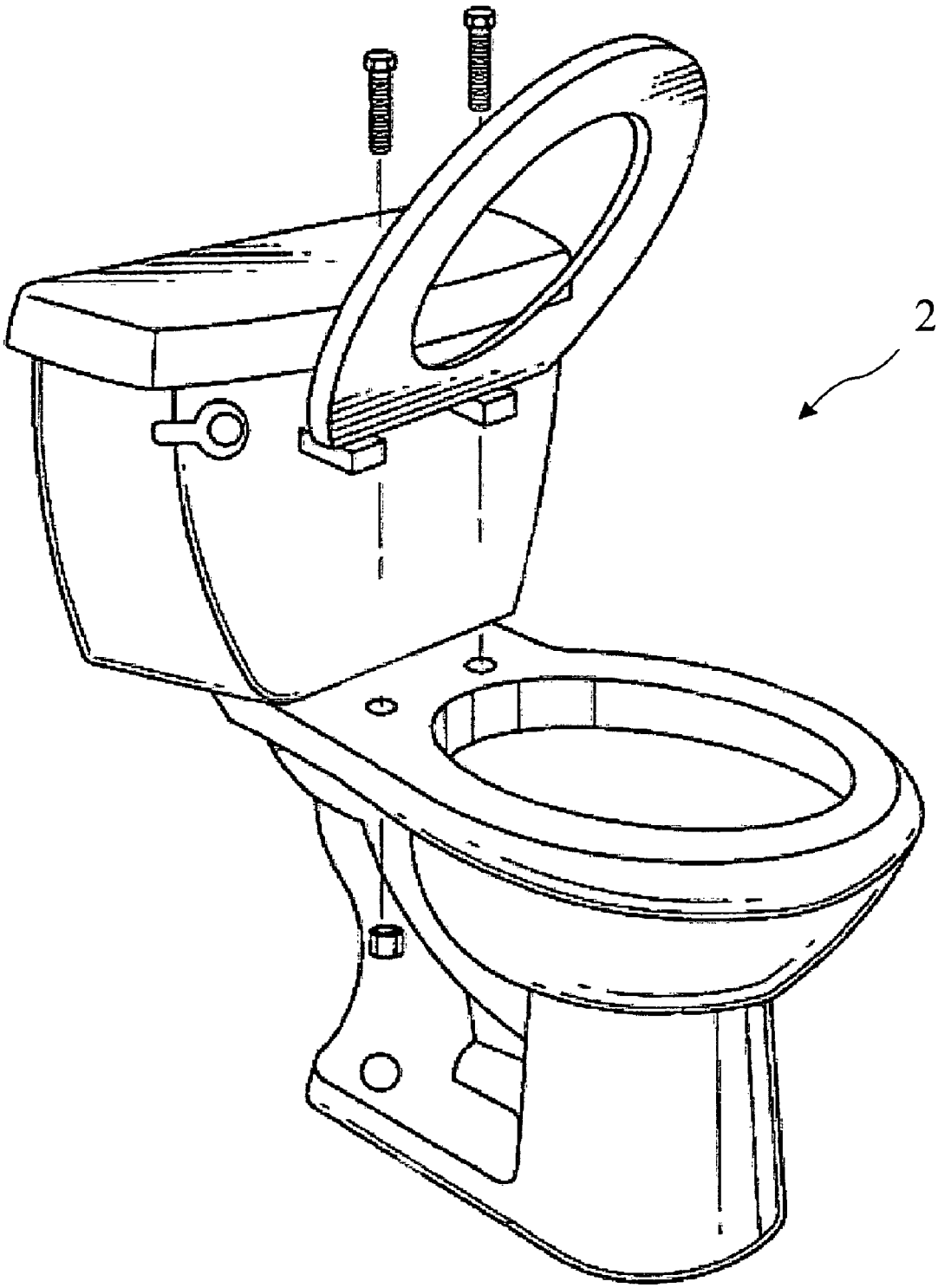
FIG. 1 (prior art)
FIG. 1 is a partially exploded perspective view of a typical prior art toilet.

The following description is of the best mode presently contemplated for carrying out the invention. This description is not to be taken in a limiting sense, but is made merely for the purpose of describing one or more preferred embodiments of the invention. The scope of the invention should be determined with reference to the claims.

As used herein, the terms "hygienic apparatus", "hygienic unit", and "hygienic system" refer without limitation to any device that can dispose, process, treat, eliminate, divert, reduce, and/or pulverize liquid, gas, or solid waste including without limitation toilets, urinals and bidets.

The terms "flow completing structure" refer to, without limitation, any structure, tubing, tubular winding, inclined tubular and/or hollow liquid and/or solid carrying structure, spiral tubing, or the like which contains a flow of waste form the containment chamber to assist in completing emptying the containment chamber.

Furthermore, the terms "low flow" refer to without limitation to any system which reduces, minimizes, or the like the requirement for inlet liquid, e.g., fresh water, recycled water, or the like.

The terms "containment chamber" refers to without limitation any chamber, vessel, container, hollow structure, or the like which receives solid waste in a container interior, holds the solid waste while the waste is broken-up, and include a container outlet allowing the broken-up solid waste to escape.

Finally, the terms "at least one shaped portion" refers to without limitation a section of a containment chamber which collects liquids and/or solids for transport or movement to a drain tube of the hygienic apparatus.

Overview

In one salient aspect, the present invention discloses an apparatus and method of producing a hygienic system, inter alia, which reduces water usage compared with known toilets. In particular, the hygienic system disclosed includes a containment chamber having an input portion and an output portion. The containment chamber configured to move liquids and solids between an inlet port and an outlet port. The containment chamber, in one exemplary embodiment, is configured to fill to a prescribed volume level. At least one shaped portion of the containment chamber prevents backflow of odor associated with the liquids and solids.

A first nozzle is disposed in the containment chamber and configured to break-up the solids using a prescribed pressure level to propel the liquids and the solids from the first port through the second port of the containment chamber. A velocity-increasing structure is disposed between the outlet port of the containment chamber and the drain tube of the hygienic system. The velocity-increasing structure provides an effective increase in the velocity of the liquids and solids.

Consequently, the present invention may be used to move or transport liquids and/or solids for a multitude of applications, such as for example for sewage treatment plants, nuclear waste plants, chemical treatment plant and other like liquid and solid treatment applications.

Broadly, the present invention generally provides an apparatus and method for providing improvements in efficiency and water usage for many liquid and solid treatment applications. The system of the present invention may find beneficial use for disposal of liquids and any solids which may be broken up by a high pressure water spray, and any system including a containment chamber and a high pressure spay directed into the containment chamber for breaking up solids and pushing the broken-up solids from the containment chamber, is intended to come within the scope of the present invention.

In yet another exemplary application, the system may prove useful for transporting liquids and solid masses that are deposited in a storm drain or other undesired location. More specifically, the system may be part of a liquid and solid waste recovery system that collects liquids and solids and/or provides these liquids and solids in a more compressed form to reduce packaging required for hauling away.

Furthermore, the same system may prove useful in a hospital and/or nursing home setting whereby liquids or solids, e.g., blood, IV apparatus, urine, solid matter, and the like, are needed to be either distributed and/or collected from each hospital recovery room and either transported or packaged for disposed in a centralized area. Consequently, an operator using this system may have the ability to track movement of liquids and/or solids on an individual basis, collectively, or sort and process separately liquid and/or solids. In addition, the system is adaptable to utilize recycled water and/or liquids so as to conserve water usage either on an individual basis or collectively if more than one of these systems are installed in a multi-room unit, for example, an apartment building, a condo, a home, or the like.

In addition, the invention is described as an automatic flush toilet using a containment chamber having at least one shaped portion that provides a holding chamber to collect the liquids and solids. Furthermore, the principles and methods of this invention may further be applied just as readily to other technologies, products, and devices, such as non-automatic hygienic systems, blood centrifuge or distribution systems, chemical treatment facilities, and water and sewage recovery facilities for dams, lakes, rivers, streams, and the like.

Exemplary Extension Apparatus

Referring now to FIGS. 2A-18, features of a hygienic system according to the present invention are described in detail. It will be appreciated that while described primarily in the context of hygienic system for transport liquid and solid waste products, at least portions of the apparatus and methods described herein may be used in other applications. Some such applications include, e.g., health monitoring and/or warehouse transport systems that transport liquids or solids from one location to another location within a larger assembly line process.

Figure 2B:
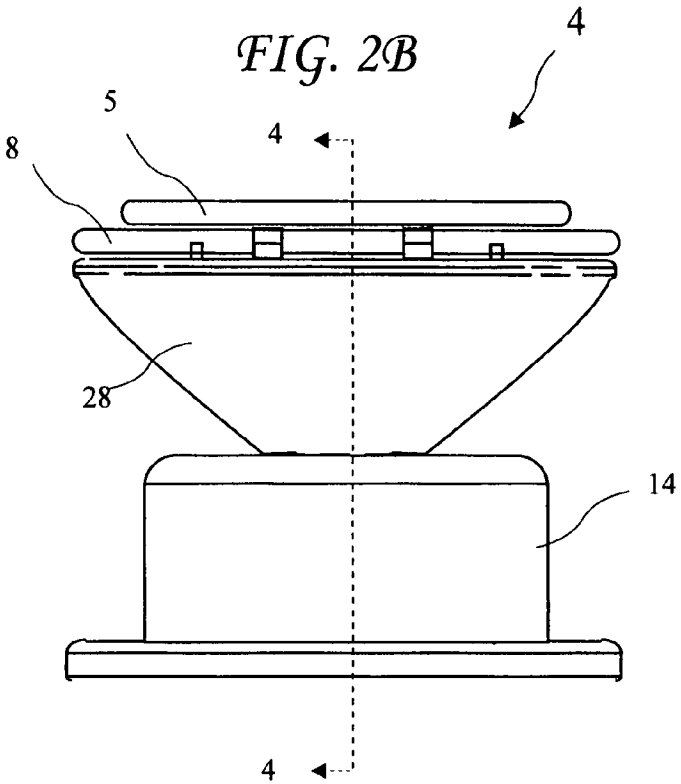
FIG. 2B is a rear view of one exemplary embodiment of the hygienic apparatus of the invention with a seat in a down position.
Figure 2A:
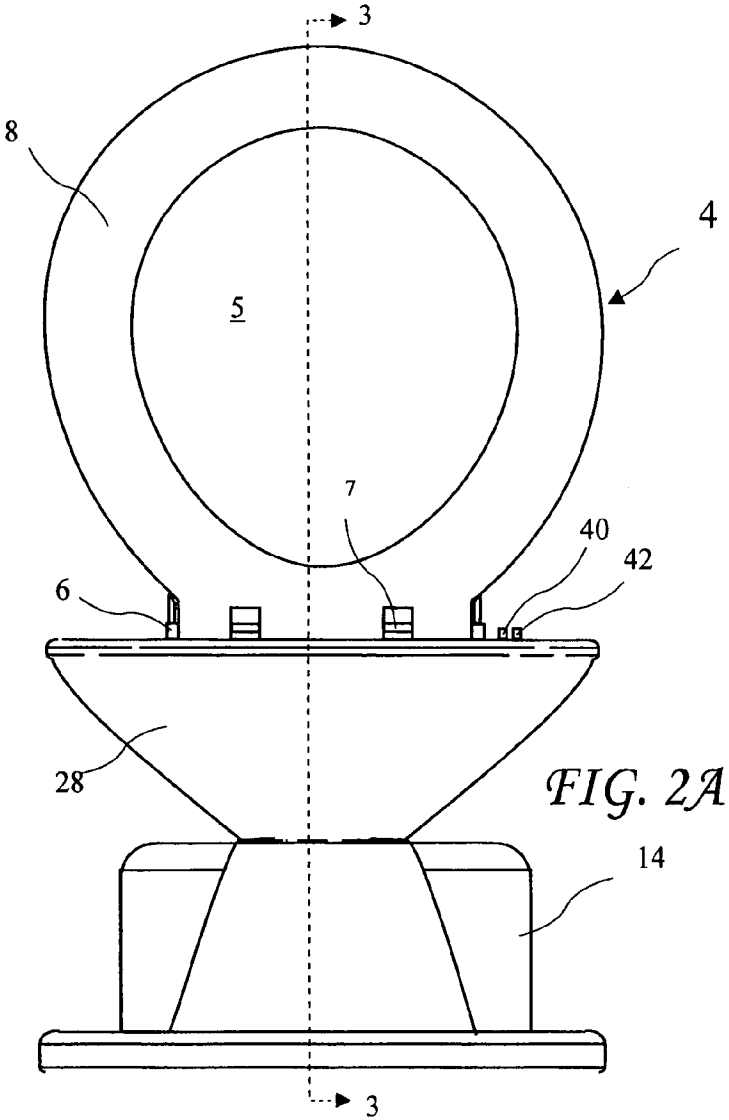
FIG. 2A is a front view of one exemplary embodiment of the hygienic apparatus of the invention with a seat in an up position.

FIG. 2A illustrates a front view of a hygienic apparatus 4 in accordance with an embodiment of the present invention with a toilet lid 5 and a toilet seat 8 in an up position and FIG. 2B illustrates a rear view of the hygienic apparatus 4 with the toilet lid 5 and the toilet seat 8 in a down position. The toilet lid 5 and the toilet seat 8 attach, e.g., using hinges 6, to a toilet base unit 14. The toilet lid 5 may be manufactured from a single layer material, a multilayer material, composite material, and/or combination of these materials. Example materials include plastic, polyurethane, wood, glass, and finished and/or painted to achieve a desired toilet esthetic or physical appearance. A toilet seat or ring 8 attaches, e.g., using hinges 7 to the toilet bowl 28, or some other feature of the hygienic apparatus 4. The toilet seat 8, in many instances, is produced or manufactured from similar materials as that of the toilet lid 5.

Figure 4:
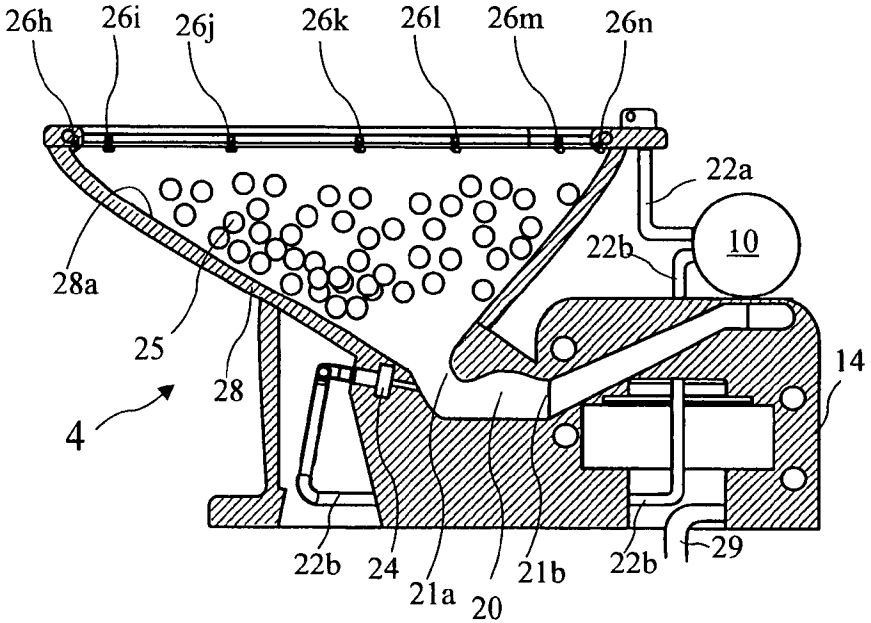
FIG. 4 is a cross-sectional left side view of the apparatus of FIG. 2B taken along line 4-4 with the seat in a down position.
Figure 3:
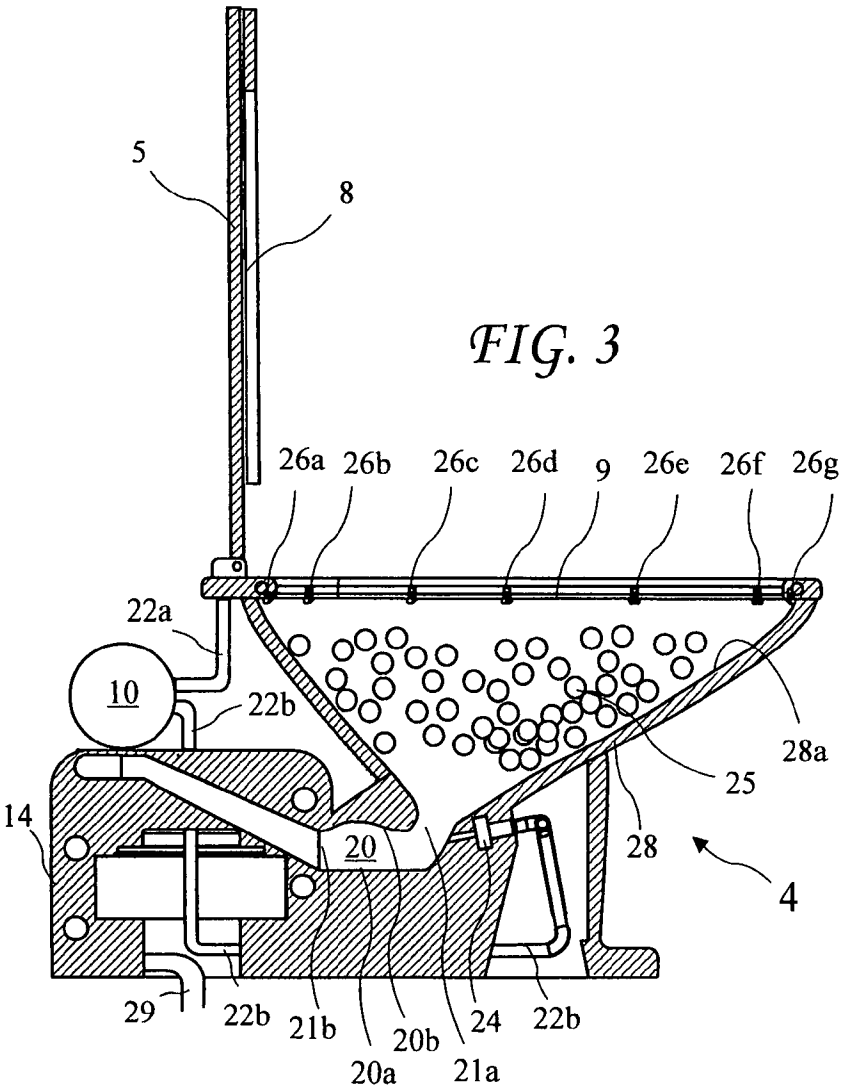
FIG. 3 is a cross-sectional right side view of the hygienic apparatus of FIG. 2A, taken along line 3-3 with the seat in an up position.

A right side cross-sectional view of the hygienic apparatus 4 taken along line 3-3 of FIG. 2A is shown in FIG. 3 with the toilet lid 5 and the toilet seat 8 in the up position and a left side cross-sectional view of the hygienic apparatus 4 taken along line 4-4 of FIG. 2B is shown in FIG. 4 with the toilet lid 5 and the toilet seat 8 in the down position. Spray jets 26*a*-26*n* (collectively spray jets 26) reside along a toilet rim 9 to pre-dampen and to further clean or clear a toilet bowl interior 28*a*.

Still referring to FIGS. 3 and 4, a fine mist of fluid droplets trickle from spray jets 26*h*-26*n* onto an inner surface 28*a* of the toilet bowl 28. In this exemplary example, when an individual (not shown) opens the toilet seat 8 for use (as shown in FIG. 2A), the fine mist of fluid droplets 25 trickle from spray jets 26*h*-26*n*. The fine mist of fluid droplets 25 adheres to the inner surface 28*a* of the toilet bowl 28 to pre-wet the inner surface 28*a*. The droplets 25 lubricate and reduce or prevent solids or liquids sticking to the toilet bowl 28. In other words, the droplets 25 reduce or prevent solids or liquids from staining the toilet bowl inner surface 28*a*. Fluids, including fluid droplets, solids and liquids, collect in a containment chamber 20, which containment chamber 20 is elongated and open to the toilet bowl 28 (i.e., unpressurized). Fluids continue to flow into the chamber 20 until the chamber 20 is filled to, in one exemplary embodiment, to a level wherein the containment chamber 20 contains approximately of one-sixteenth to one-eighth of a gallon. The containment chamber 20 thus serves as a reservoir which provides a collection area for containing the fluids entering the toilet bowl 28. The containment chamber 20 includes a chamber floor 20*a*, a chamber ceiling 20*b*, a chamber inlet 21*a*, and a chamber outlet 21*b*, and a container interior bounded by the container floor 20*a*, the chamber ceiling 20*b*, the chamber inlet 21*a*, and the chamber outlet 21*b*. The chamber floor 20*a* is preferably straight and the chamber ceiling 20*b* is preferably concave upward. The toilet base 14 provides housing for the containment chamber 20. As compared to conventional standard toilets, no polymer (e.g. rubber) or other type of seals (e.g., wax) is required because fluid is maintained in the containment chamber 20. Thus, this invention is not subject to failures associated with faulty seals.

Still referring to FIGS. 3 and 4, a fine mist of fluid droplets trickle from spray jets 26*h*-26*n* onto an inner surface 28*a* of the toilet bowl 28. In this exemplary example, when an individual (not shown) opens the toilet seat 8 for use (as shown in FIG. 2A), the fine mist of fluid droplets 25 trickle from spray jets 26*h*-26*n*. The fine mist of fluid droplets 25 adheres to the inner surface 28*a* of the toilet bowl 28 to pre-wet the inner surface 28*a*. The droplets 25 lubricate and reduce or prevent solids or liquids sticking to the toilet bowl 28. In other words, the droplets 25 reduce or prevent solids or liquids from staining the toilet bowl inner surface 28*a*. Fluids, including fluid droplets, solids and liquids, collect in a containment chamber 20, which containment chamber 20 is elongated and open to the toilet bowl 28 (i.e., un pressurized). Fluids continue to flow into the chamber 20 until the chamber 20 is filled to, in one exemplary embodiment, to a level wherein the containment chamber 20 contains approximately of one-sixteenth to one-eighth of a gallon. The containment chamber 20 thus serves as a reservoir which provides a collection area for containing the fluids entering the toilet bowl 28. The containment chamber 20 includes a chamber floor 20*a*, a chamber ceiling 20*b*, a chamber inlet 21*a*, and a chamber outlet 21*b*, and a container interior bounded by the container floor 20*a*, the chamber ceiling 20*b*, the chamber inlet 21*a*, and the chamber outlet 21*b*. The chamber floor 20*a* is preferably a straight flat generally horizontal floor and the chamber ceiling 20*b* is preferably concave upward. The toilet base 14 provides housing for the containment chamber 20. As compared to conventional standard toilets, no polymer (e.g. rubber) or other type of seals (e.g., wax) is required because fluid is maintained in the containment chamber 20. Thus, this invention is not subject to failures associated with faulty seals.

Still referring to FIGS. 3 and 4, a fine mist of fluid droplets trickle from spray jets 26*h*-26*n* onto an inner surface 28*a* of the toilet bowl 28. In this exemplary example, when an individual (not shown) opens the toilet seat 8 for use (as shown in FIG. 2A), the fine mist of fluid droplets 25 trickle from spray jets 26*h*-26*n*. The fine mist of fluid droplets 25 adheres to the inner surface 28*a* of the toilet bowl 28 to pre-wet the inner surface 28*a*. The droplets 25 lubricate and reduce or prevent solids or liquids sticking to the toilet bowl 28. In other words, the droplets 25 reduce or prevent solids or liquids from staining the toilet bowl inner surface 28*a*. Fluids, including fluid droplets, solids and liquids, collect in a containment chamber 20. Fluids continue to flow into the chamber 20 until the chamber 20 is filled to, in one exemplary embodiment, to a level wherein the containment chamber 20 contains approximately of one-sixteenth to one-eighth of a gallon. The containment chamber 20 thus serves as a reservoir which provides a collection area for containing the fluids entering the toilet bowl 28. The containment chamber 20 includes a chamber floor 20*a*, a chamber ceiling 20*b*, a chamber inlet 21*a*, and a chamber outlet 21*b*, and a container interior bounded by the container floor 20*a*, the chamber ceiling 20*b*, the chamber inlet 21*a*, and the chamber outlet 21*b*. The chamber floor 20*a* is preferably a straight flat horizontal floor and the chamber ceiling 20*b* is preferably concave upward. The toilet base 14 provides housing for the containment chamber 20. As compared to conventional standard toilets, no polymer (e.g. rubber) or other type of seals (e.g., wax) is required because fluid is maintained in the containment chamber 20. Thus, this invention is not subject to failures associated with faulty seals.

Figure 5A:
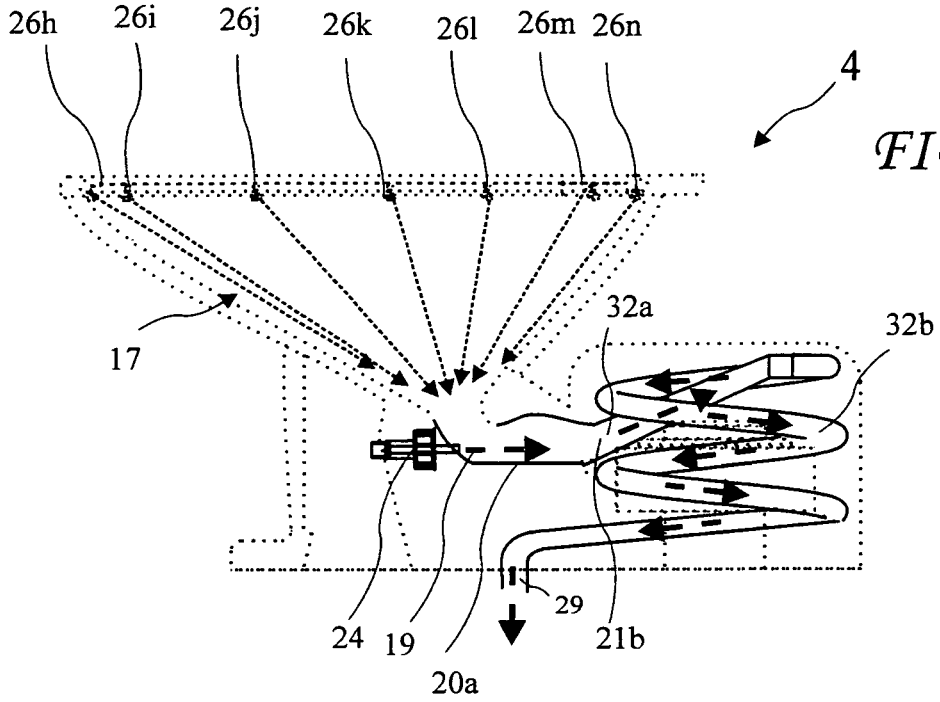
FIG. 5A is a left side view of the hygienic apparatus showing spays and flows according to the present invention used to operate the hygienic apparatus.
Figure 5B:
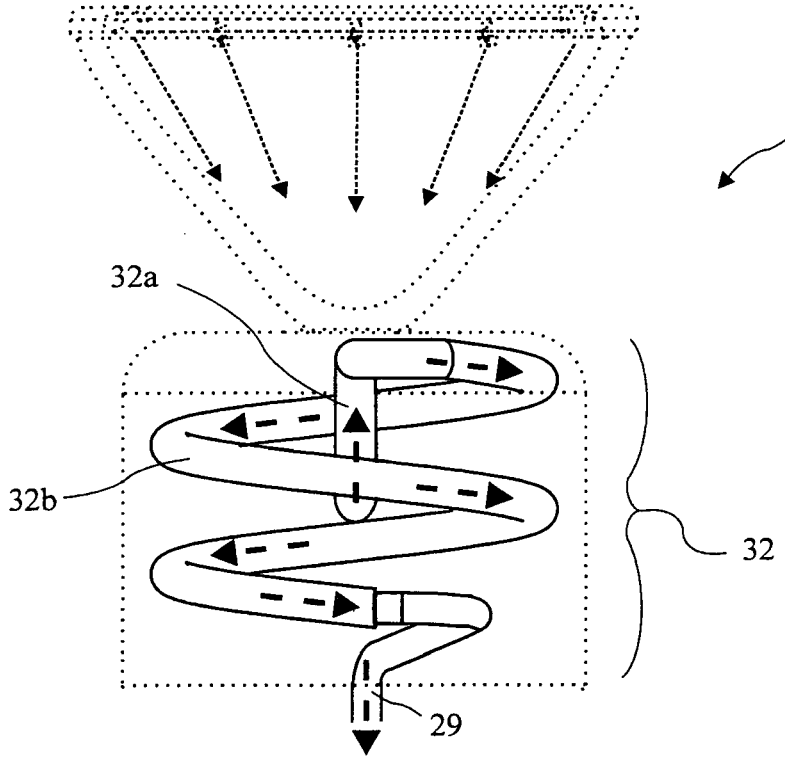
FIG. 5B is a rear view of the hygienic apparatus showing the spays and the flows used to operate the hygienic apparatus, including a spiral flow completing structure.

A left side view of a spiral flow completing structure 32*b* of the hygienic apparatus 4 is shown in FIG. 5A and a rear view of a spiral flow completing structure 32*b* of the hygienic apparatus 4 is shown in FIG. 5B. The spiral flow completing structure 32*b* connects between the chamber outlet 21*b* and a drain tube 29. An incline ramp 32*a* preferably connects the spiral flow completing structure 32*b* to the chamber outlet 21*b*. The spiral flow completing structure 32*b* is preferably a generally horizontal spiral sized to contain a sufficient amount of liquid and broken-up solid waste to draw any liquid and broken-up solid waste remaining in the containment chamber 20 from the containment chamber 20 at the completion of a flushing cycle. The high pressure flow 19 is approximately horizontal and parallel to the chamber floor 20*a* and is preferably between approximately 1/16 inches and approximately 3/8 inches above the floor 20*a* and more preferably between approximately 1/16 inches and approximately 1/4 inches above the floor 20*a*.

A first embodiment of the spiral flow completing structure 32*b* comprises a spiral of approximately one inch to approximately one and one half inch diameter tubing, and is suitable for the hygienic apparatus 4 when the high pressure nozzle 24 is fully functional and provides the high pressure spray 19 to break-up solids. A second embodiment of the completing structure 32*b* comprises a spiral of approximately two inch to approximately two and one half inch diameter tubing, and is suitable for the hygienic apparatus 4 when the high pressure nozzle 24 is not functional and a low pressure spray of water (household water pressure) is used to fill and flush the hygienic apparatus 4 using a higher volume of water (see FIG. 15), for example, when electrical power is not available to the pump 10). The completing structure 32*b* may be constructed from PVC pipe, although it will be apparent that any number of other materials may be used instead or in conjunction with the PVC and the completing structure 32*b* may be manufactured of a rigid, semi-rigid, or flexible single or composite material.

The completing structure 32*b* in combination with the flowing liquids and solids form a vacuum which increases a velocity of the solids and liquids through the completing structure 32*b*. This increase in velocity and selection of pipe diameter takes advantage of the molecular attractive properties of solids and liquids to realize an increase suction device. Thus, the completing structure 32*b* reduces the need for additional water, such as those required by gravity-powered toilets to push the solids and liquids toward the drain tube 29. The completing structure 32*b* in combination with the flowing liquids and solids form a vacuum that increases a velocity of the solids and liquids. Thus, the completing structure 32*b* reduces the need for additional water, such as that required by gravity-powered toilets to push the solids and liquids toward the drain tube 29.

In an alternative embodiment, the nozzle 24 may be replaced by a main nozzle and a secondary nozzle where either one or the other may be used for different purposes, for example, one could be for applying soap and the other providing rinse water.

In contrast to standard or low flow toilets, the nozzle 24 directs the high pressure spray into the containment chamber 20, which chamber 20 has a shaped portion for holding the solids and liquids. The cooperation of the high pressure spray 19 and the chamber 20 provides an improved hygienic system which breaks-up solids, prevents splashing during breaking-up process, and moves both solid and liquid particles from the chamber 20 into the completing structure 32*b*.

An advantage of the hygienic apparatus 4 as compared to prior art toilets which utilize one and a half (low-flow) to three gallons (standard flow) of water, is that the high pressure nozzle 24 with the aid of the pump 10 requires only approximately one sixteen to one eighth of a gallon of water, thereby greatly conserving water. Furthermore, the exemplary embodiment of the present invention remains cleaner than know toilets because pre-wetting the inner surface 28*a* by spray jets 26 reduces or prevents build and stains on the inner surface 28*a*, thereby reducing the fluid required for reducing or preventing incidental solid or liquid build-up on the inner surface 28*a*. Furthermore, in contrast to conventional standard toilets, the hygienic apparatus according to the present invention requires no rubber or other seal to store water in a toilet tank. Thus, this system does not depend on the integrity of any seal to prevent fluid leakage and therefore waste.

A right side view of the hygienic apparatus 4 shown in FIG. 6 identifies details A and B. Detail A showing the spray jets 26*g* is shown in FIG. 7. In one embodiment, the spray jet 26*g* has a tapered construction comprising an input port 27*a* and a reduced cross-section slotted output orifice 27*b*. The slotted orifice 27*b*, in this example, a smaller cross-sectional area than the input port 27*a*.

Detail B showing the high pressure nozzle 24 is shown in FIG. 8. The high pressure nozzle 24 includes an input port 24*b* and a reduced cross-section output orifice 24*a*. The nozzle 24 is further shown in detail in side view in FIG. 9A, in top view in FIG. 9B, and in front view in FIG. 9C.

Figure 10:
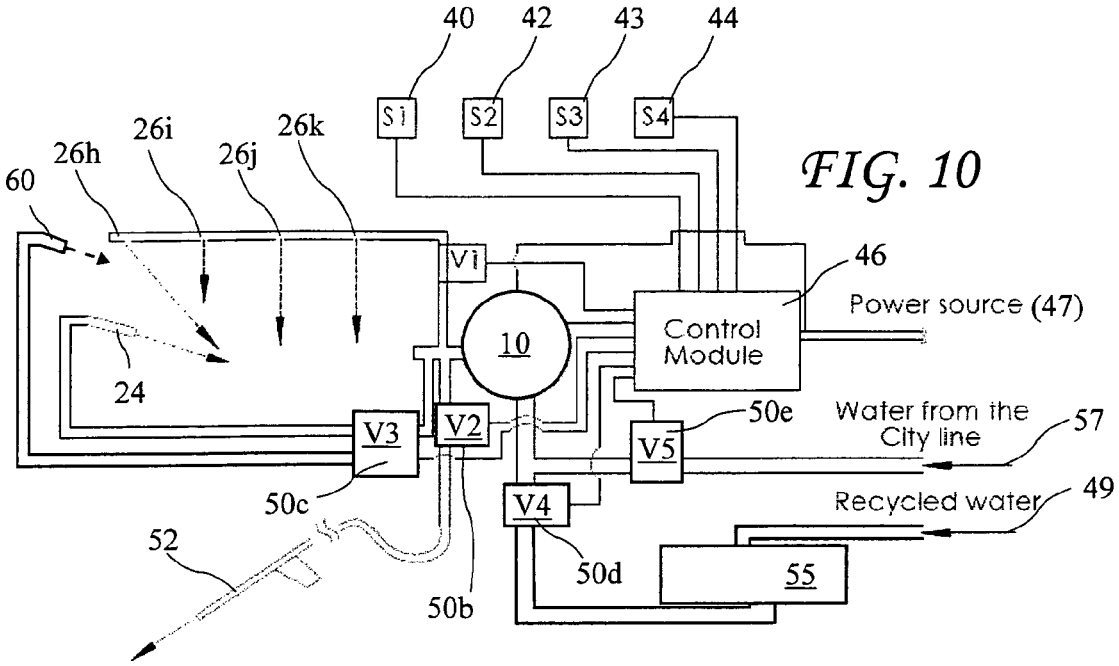
FIG. 10 illustrates a system layout of a hygienic apparatus in accordance with the present invention.

FIG. 10 illustrates a block diagram for a hygienic system apparatus in accordance with an embodiment of the present invention. Switches 40-44 (S1-S4) are part of a user-sensing unit. The user sensing unit may be stimulated by a variety of activities by a user, e.g., lifting the toilet seat, closing the toilet seat, or sitting on the toilet seat (see FIG. 2A for positions of switches 40 and 42). Electrical or mechanical interlocks may also be provided such that certain operations or actions are allowed or prohibited depending on the state or status of various of the components. Moreover, other sensing apparatus (such as infrared or ultrasonic motion or position sensors of the type well known in the electronic arts) may be used to enable, or disable certain components, and/or activate or terminate certain operations.

In the illustrated embodiment, upon opening the toilet lid, e.g., switch 40 (S1) closes, and sends an electrical signal to a module 46. The module 46, in this example, is an electronic switch array, which could be part of a central processing unit (not shown), that activates or deactivates the pump 10. In an alternative embodiment, the module 46 may be a mechanical array that directs which sprayer(s) or nozzle to activate.

For instance, the module 46 may deactivate the pump 10 selected times of a day. For example, the pump 10 may be deactivated in the evening hours, during sleep time, or when no one his home to conserve energy and minimize any noise originating from the pump. Furthermore, the module 46 activates or deactivates valves 50*a-e* (V1-V5). The valves 50*a-e* may have a valve member, e.g., that opens and closes, for selectively pumping fluid originating from the pump 10 to a location within, on, or outside of the hygienic apparatus.

For example, if switch 40 (S1) closes, control module 46 activates value 50*a* (V1) to transport fluid to spray jets 26*h*-26*k*. The spray jets 26*h*-26*k* spray fluid from the toilet rim onto an interior surface of the toilet bowl 28. The spray fluid for the spray jets 26*h*-26*k* may originate from water from the city line 57, recycled water 49, and recycled water from a tank 55. In an alternative embodiment, the recycled water from a tank 55 may come from other water usages, such as shower water, bathroom sink, laundry room basin, storm drain, home gutter, or the like. Thus, water may be utilized from other activities, e.g., recycled, near or from devices connected to the hygienic apparatus 4. As compared to conventional hygienic systems, such as the standard toilet, this system has the advantage of saving water not only by economizing usage by having a "low flow" design, but also by reusing previous used water for the purpose of toilet flushing or rinsing.

In addition, because the hygienic apparatus 4 in this example flushes upon being closed, cleanliness will be improved because during a flush, the toilet lid or cover 5 will prevent backsplash from solids and liquids becoming airborne and landing on individuals or the adjacent environment.

Finally, nozzles 24 and 60, and spray jets 26*h*-26*k* may be independently controlled, e.g., activated or deactivated, and additional water savings results because the spray jets 26*h*-26*k* may be activated only when necessary, e.g., depending on the solid and the liquid deposited, as compared to conventional standard toilet having the same flush independent of the solid and the liquid deposited. Furthermore, cleaning enzymes or other substances may be added to the recycled water tank so that the hygienic apparatus may be utilized to clean the toilet 28. The valve 50*c* (V3) controls the high pressure flow to the high pressure nozzles 24 and 60 so that the resulting high pressure sprays are correctly timed (see FIG. 19).

In yet another embodiment, valve 50*b* (V2) is opened so that handheld nozzle 52 may be utilized. For instance, handheld nozzle 52 may be used to clean other surfaces or structures, such as shower door, shower wall, bathtub, sink, floor, and the like. After the solid and the liquid are deposited in the containment chamber 20 (see FIG. 3), the toilet seat 5 is closed. The closed toilet set 5 causes switch 43 (S3) to close and nozzle 24 becomes activated. When activated, the nozzle 24 sprays fluid to break-up solids and transport both solids and liquids from the containment chamber (see FIGS. 5A and 5B) toward the completing structure 32*b*. Furthermore, if the pump 10 malfunctions, the pump will pass water at approximately the input pressure level, e.g., such as regular pressure from the city line, approximately 50 p.s.i. in this example (see FIG. 15). Thus, the hygienic system 4 functions even when the pump 10 fails.

Figure 11:
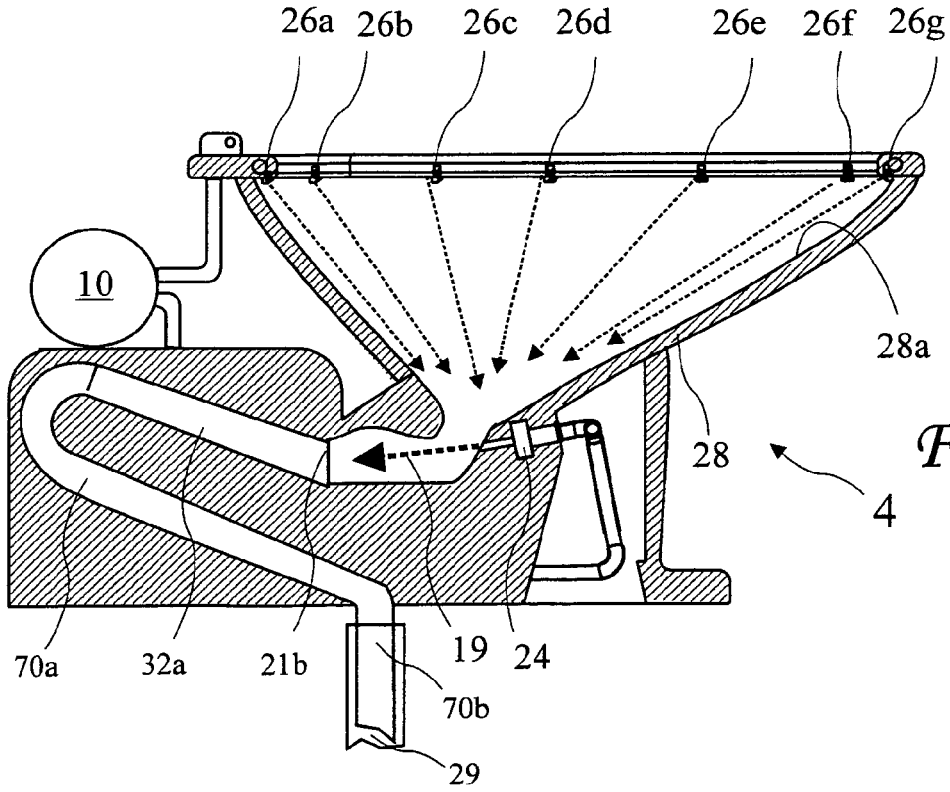
FIG. 11 shows a second flow completing structure including tubing extending somewhat into a drain pipe.

A second embodiment of a completing structure comprising a vertical loop 70*a* and tube 70*b* are shown in FIG. 11 connected between the ramp 32*a* and into the drain 29. The diameters and lengths of the loop 70*a* and tube 70*b* are selected so that sufficient liquid and broken-up solid waste will be held in the vertical loop 70*a* and tube 70*b* at the end of a flush cycle to draw any remaining liquid and broken up waste in the containment chamber 20 from the containment chamber 20 to complete the flush cycle. The extended pipe 70*c*, in one embodiment, increases the velocity of solids and liquid flow by increasing pressure flow, for example, for masses originating from the pipes 70*b* and 70*c*. The arrows illustrate a fluid flow from representative spray jets 26 and representative high pressure nozzle 24 for the solids and liquids that pass through the containment chamber 20 to the drain tube 29.

The tube 70*b* preferably extends into the drain tube 29 between approximately 2 feet and approximately 5 feet. A first embodiment of the vertical loop 70*a* and tube 70*b* comprises tubing of approximately one inch to approximately one and one half inch diameter tubing, and is suitable for the hygienic apparatus 4 when the high pressure nozzle 24 is fully functional and provides the high pressure spray 19 to break-up solids and pushing the liquid and broken-up solid waste from the chamber 20. A second embodiment of the vertical loop 70*a* and tube 70*b* comprises tubing approximately two inch to approximately two and one half inch diameter tubing, and is suitable for the hygienic apparatus 4 when the high pressure nozzle 24 is not functional and a low pressure spray of water (household water pressure) is used to fill and flush the hygienic apparatus 4 using a higher volume of water (see FIG. 15), for example, when electrical power is not available to the pump 10). The loop 70*a* and tube 70*b* may be constructed from PVC pipe, although it will be apparent that any number of other materials may be used instead or in conjunction with the PVC and the loop 70*a* and tube 70*b* may be manufactured of a rigid, semi-rigid, or flexible single or composite material.

In yet another alternative embodiment, an external pipe, for example a plastic rigid or flexible pipe, may replace the loop 70*a* and tube 70*b*. The external pipe has a preferred diameter selected from a range between approximately one inch and approximately 1.5 inches. The external pipe, in one preferred embodiment, has one portion that extends into the drain tube 29, similar to the tube 70*b*. The extension of the external pipe is, in one preferred embodiment, between one foot to 5 feet.

Furthermore, the external pipe also has a curved portion (e.g., a winding portion) afterwards partially straightens to mate with an chamber output 21*b* of the containment chamber 20. The external pipe may be detachable so that clogs may be easily removed and afterwards the external pipe then reattached. The external pipe diameter of between approximately one inch and approximately 1.5 inches is chosen increase solid and liquid suction so that the broken-up solid masses and liquids may readily transport to the drain tube 29. The suction increase results in part due to the molecular attraction of liquid and solid particles deposited in the containment chamber 20. In yet another variation of this embodiment, a sink output drain, not shown, may be connected along the sewer line proximal to the drain tube 29. In this alternative embodiment, discharge from the sink may further increase velocity of liquids and solids that enter the outlet port.

Figure 12A:
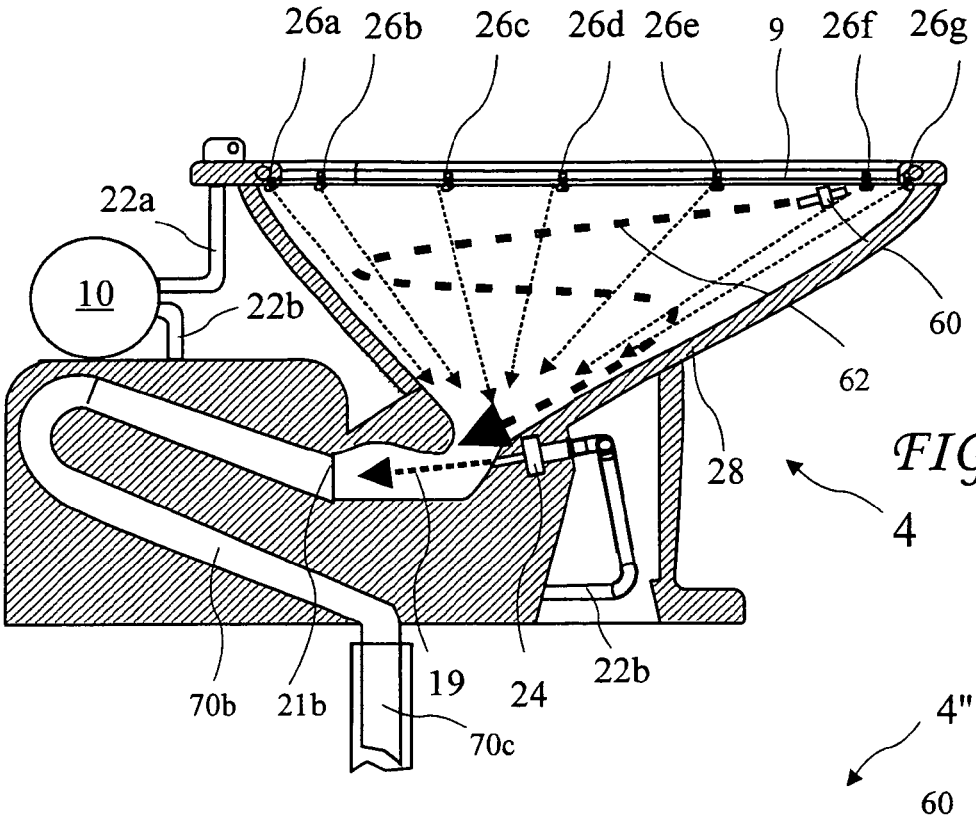
FIG. 12A is a side view of a hygienic apparatus in accordance with the present invention, including a second high pressure nozzle residing under the rim and providing a spiral flow in the bowl.
Figure 12B:
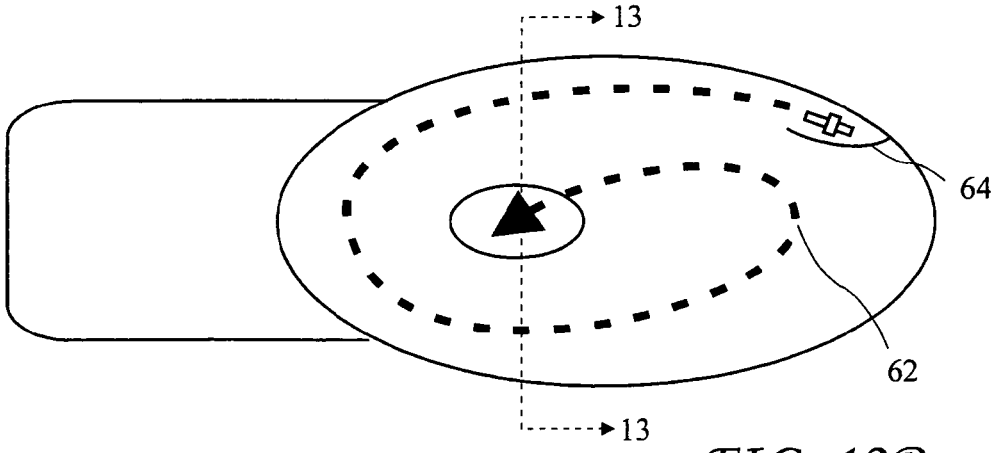
FIG. 12B is a top view of the hygienic apparatus including the second high pressure nozzle

An embodiment of the hygienic apparatus 4" including a second high pressure nozzle 60 for creating a spiral flow 62 inside the toilet bowl 28 is shown in FIG. 12A in side view and in FIG. 12B in top view. The high pressure nozzle 60 is mounted just below the rim 9 and produces the spiral flow 62 tangential to the bowl inner surface 28*a* and preferably with a slight down angle. The nozzle 60 is aimed to result in a spiral flow 62 of just over one revolution before the spiral enters the containment chamber 20. Because the flow 62 may be high pressure and potentially dangerous to children or even adults, a guard 64 may be placed over the nozzle 60 to prevent fingers from being places directly in the beginning of the flow.

Figure 13:
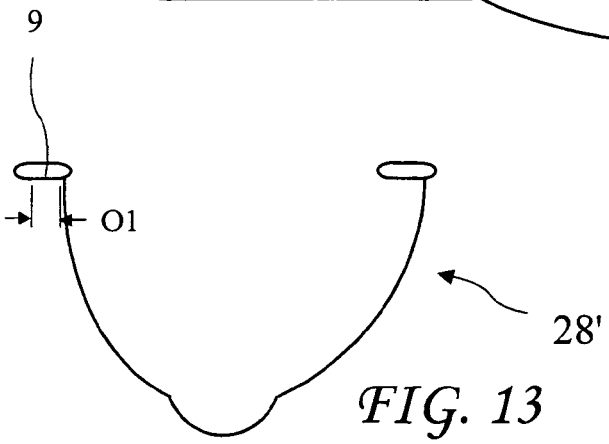
FIG. 13 is a cross-sectional view of a toilet bowl according to the present invention having one side offset to improve the spiral flow.

A cross-sectional view taken along line 13-13 of FIG. 12B of the hygienic apparatus 4" configured for the spiral flow 62 is shown in FIG. 13. The left side of the bowl 28' is biased inwards by an offset O1 to help direct the spiral flow 62 as the flow 62 originates from the nozzle 60. The offset O1 is preferably approximately 1.5 inches.

Figure 14:
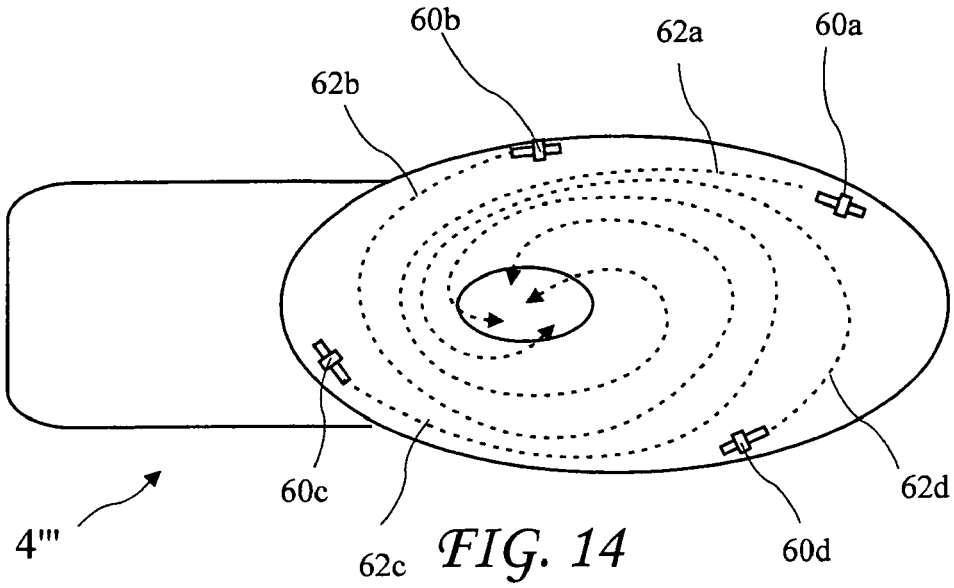
FIG. 14 shows several second high pressure nozzles creating the spiral flow in the bowl.

A second embodiment of the hygienic apparatus 4'" including a plurality of high pressure nozzles 60*a*-60*d* producing a plurality of spiral flows 62*a*-62*d* is shown in FIG. 14. The hygienic apparatus 4'" is otherwise similar to FIGS. 12A and 12B.

Figure 15:
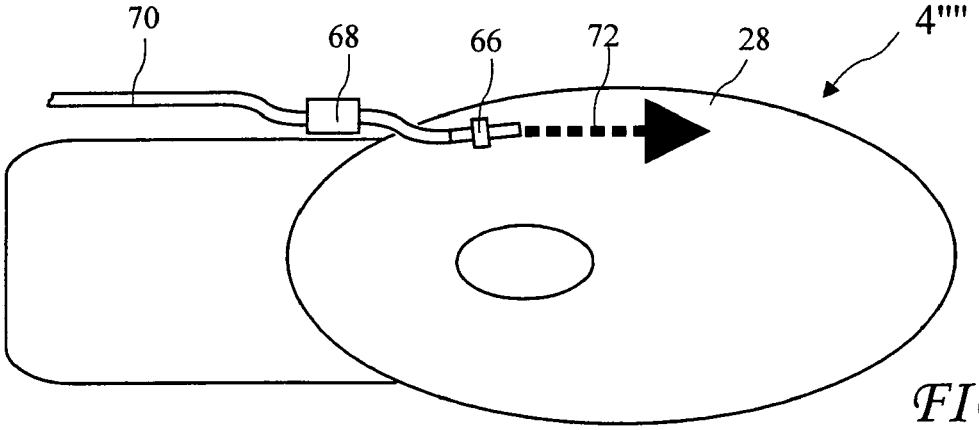
FIG. 15 shows manual flush apparatus.

An embodiment of the hygienic apparatus 4 including a manual flushing feature is shown in FIG. 15. A low pressure, high volume nozzle 66 resides inside the bowl 28. The nozzle 66 receives a household water flow 70 at typically 50 PSI controlled by a manual valve 68. If the pump 10 fails, or power to operated the hygienic apparatus 4 is lost, the hygienic apparatus 4 may be flushed using the manual flushing feature. In this case, larger diameter completing structures are recommended for proper operation.

Figure 16:
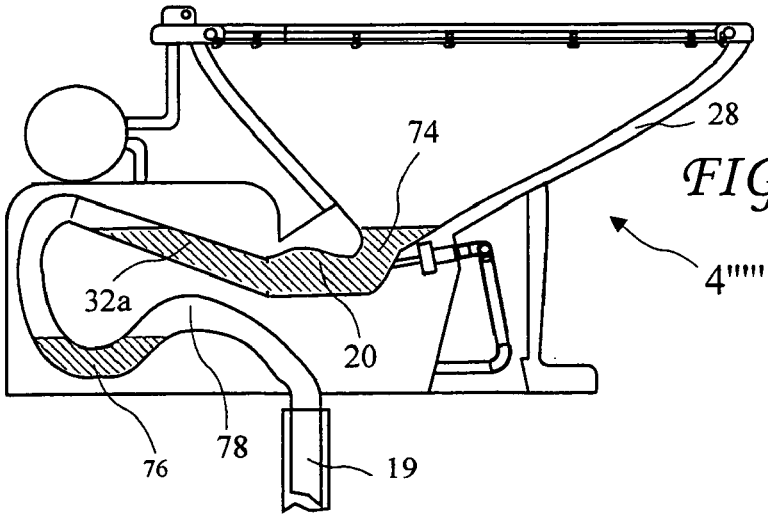
FIG. 16 shows a first sewer trap including the containment chamber and a second sewer trap comprising a low point in the flow completing structure.

Standard and secondary sewer traps 74 and 76 of the hygienic apparatus 4 are shown in FIG. 16. The standard sewer trap 74 is created by residual water in the containment chamber 20 and tube 32*a*. The secondary trap 76 may be provided by incorporating a raised exit portion 78 following the spiral completing structure 32*b* or the loop 70*a* to trap water in the tubing. In either instance, the trapped water prevent vapors backing up from the drain 29 and causing odors.

Figure 17:
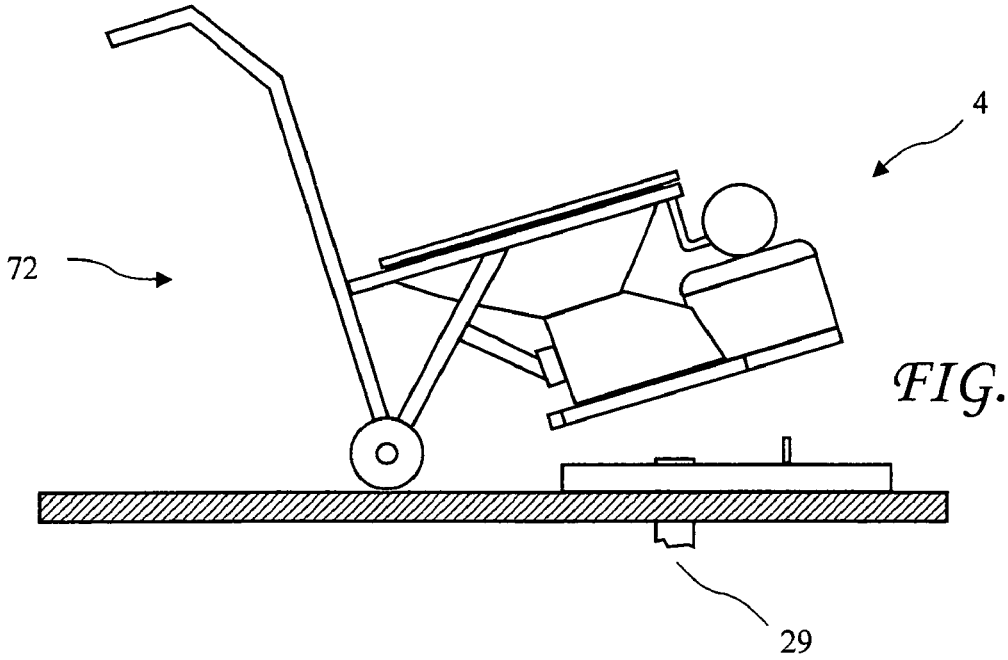
FIG. 17 illustrates a dolly utilized to transport the hygienic apparatus according to the present invention.

FIG. 17 is an illustration of a means and method of transporting the hygienic apparatus 4 in accordance with an embodiment of the present invention. In this embodiment, a hygienic apparatus 4 is transported using a dolly 72. FIG. 8 shows that the hygienic apparatus 4 is transportable and has an drain tube 29 that mates with an output port of a standard toilet. Thus, the hygienic apparatus 4 has been adapted to fit within the standard footprint created by a standard or low flow toilet. The dolly 72 may be specially adapted to fit the apparatus 4, or alternatively the apparatus 4 can be designed to have a substantially standardized shape or profile, such that a one-size-fits-all type dolly 72 can be used without special adaptation.

Figure 18:
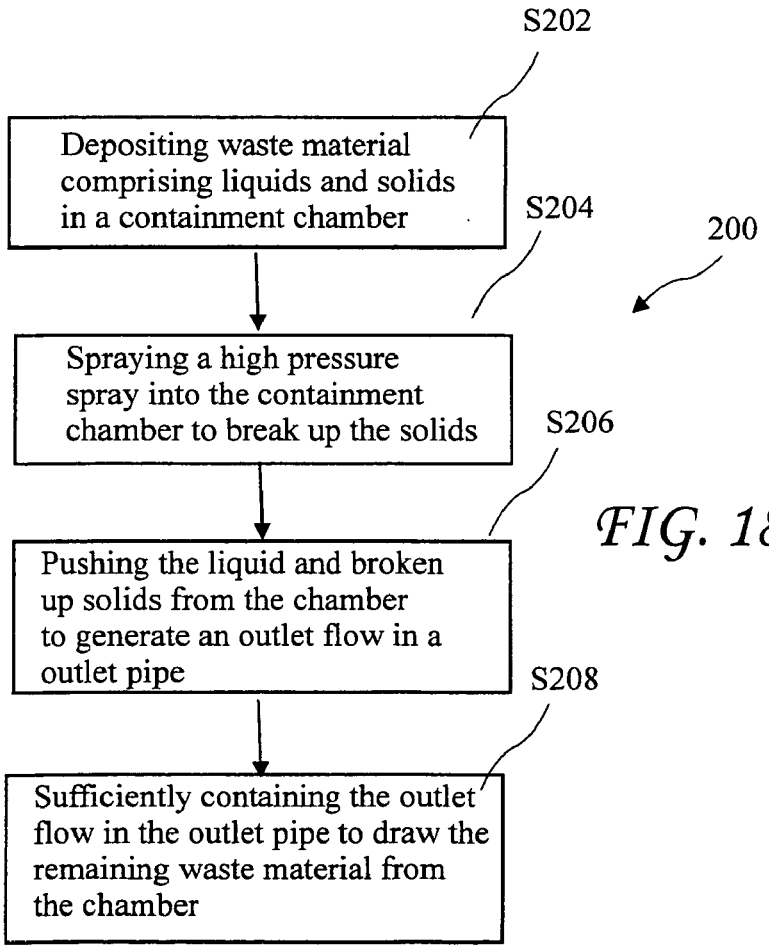
FIG. 18 is a method of operating the hygienic apparatus according to the present invention.

A method 200 according to the present invention is shown in FIG. 18. The method 200 includes depositing waste material comprising liquids and solids in a containment chamber (S202), spraying a high pressure spray into the containment chamber to break up the solids (S204), pushing the liquid and broken up solids from the chamber to generate an outlet flow in a outlet pipe (S206), and sufficiently containing the outlet flow in the outlet pipe to draw the remaining waste material from the chamber (S208). The method 200 may further include a first step of pre-wetting the inner surface 28*a* of the toilet bowl to prevent waste material from sticking on or staining the inner surface 28*a*.

Figure 19:
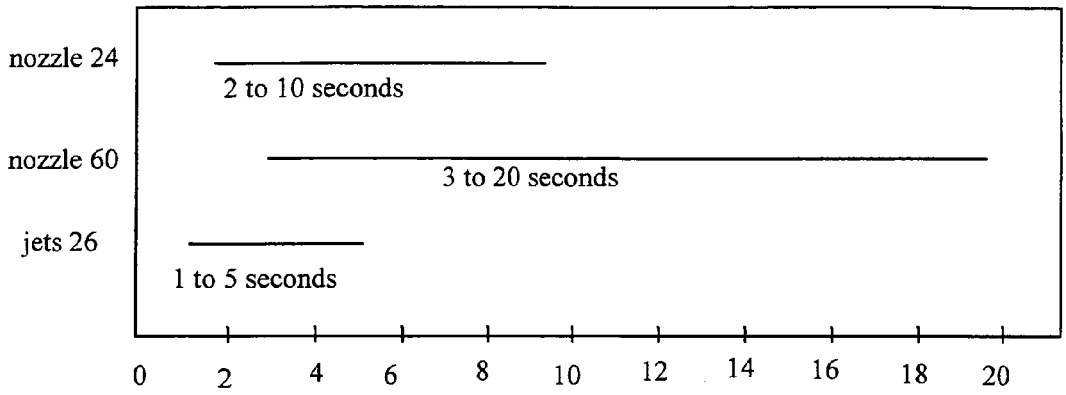
FIG. 19 shows a time-line for operating the hygienic apparatus according to the present invention.

A time-line for operating the hygienic apparatus according to the present invention is shown in FIG. 19.

Figure 20A:
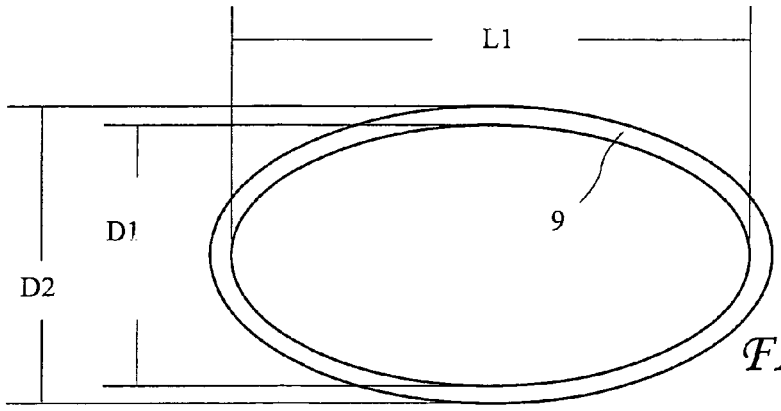
FIG. 20A shows a top view of the hygienic apparatus according to the present invention with dimensions.
Figure 20B:
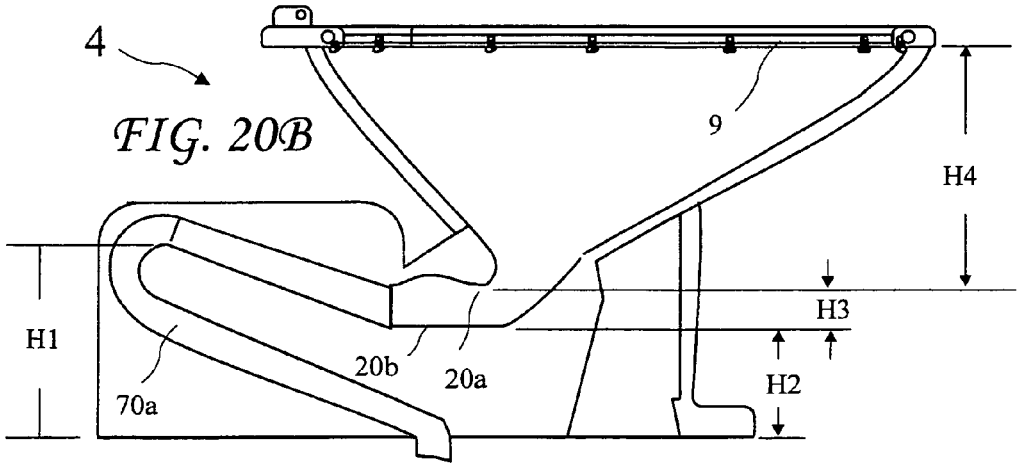
FIG. 20B shows a right side view of the hygienic apparatus according to the present invention with dimensions.

A top view of the hygienic apparatus according to the present invention a right side view of the hygienic apparatus according to the present invention with dimensions is shown in FIG. 20B. The rim 9 is approximately elliptical with an minor inside diameter D1 of approximately 11 inches and a minor outside diameter D2 of approximately 14.5 inches. The outside length (or major diameter) L1 is approximately 16.5 inches. The competing section 70*a* has a height H1 from the floor of approximately 8 inches, The chamber floor 20*b* has a height H2 from the floor of approximately 4 inches, the chamber ceiling 20*a* has a height H3 from the chamber floor 20*b* of approximately 2 inches, and the rim 9 has a height H4 from the chamber ceiling 20*a* of approximately 8.5 inches.

Figure 21A:
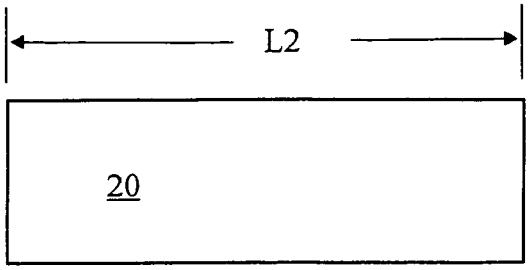
FIG. 21A is a side view of the containment chamber according to the present invention.
Figure 21B:
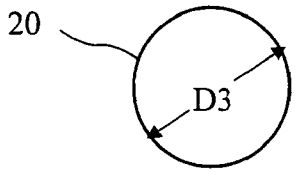
FIG. 21B is an end view of the containment chamber according to the present invention.

A detailed side view of the chamber 20 is shown in FIG. 21A, and a detailed end view of the chamber 20 is shown in FIG. 21B. The chamber 20 has a length L2 which is preferably between approximately one inch and approximately seven inches, and a diameter D3 which is between approximately 1.5 inches and approximately 2.5 inches, and the may be elliptical.

Figure 22:
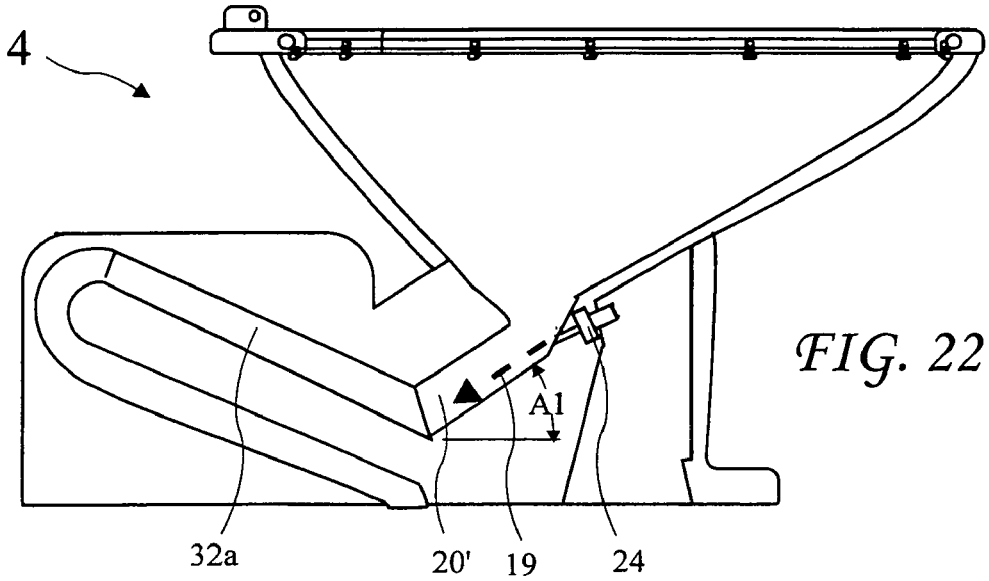
FIG. 22 shows an embodiment of the hygienic apparatus according to the present invention with an angled containment chamber.

FIG. 22 shows an embodiment of the hygienic apparatus according to the present invention with a downward angled containment chamber 20'. The angled chamber 20' is tilted by an angle A1 of from approximately one degree to approximately 60 degrees and is preferably lifted by an angle A1 of approximately 30 degree. The high pressure nozzle 24 is angled at the same angle A1 to remain parallel with the chamber floor.

Figure 23:
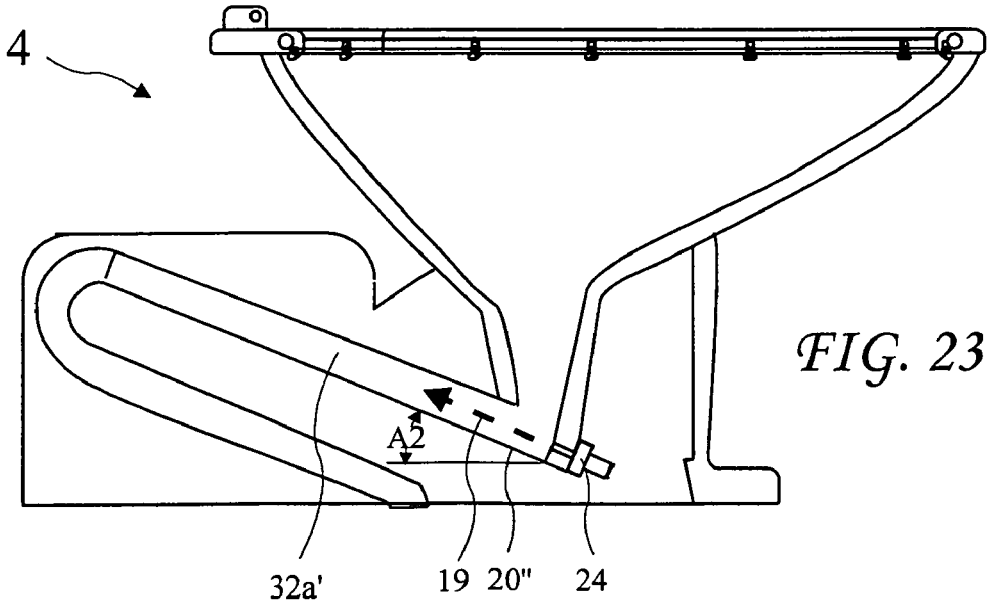
FIG. 23 shows an embodiment of the hygienic apparatus according to the present invention with the containment chamber being part of an inclined ramp.

FIG. 23 shows an embodiment of the hygienic apparatus according to the present invention with an upward angled containment chamber 20" which is a straight (or nearly straight) extension of a second inclined ramp 32*a'*. The angled chamber 20" is thus tilted by an angle A2 which is the same as the tilt of the inclined ramp 32*a'*. The angle A2 is preferably approximately 30 degree. The high pressure nozzle 24 is angled at the same angle A2 to remain parallel with the chamber floor and preferably between approximately 1/16 inches and approximately 3/8 inches above the floor and more preferably between approximately 1/16 inches and approximately 1/4 inches above the floor.

It is noted that many variations of the methods described above may be utilized consistent with the present invention. Specifically, certain steps are optional and may be performed or deleted as desired. Similarly, other steps (such as additional water or fluid processing, filtration, chemical treatment, sampling/analysis, etc.) may be added to the foregoing embodiments. Additionally, the order of performance of certain steps may be permuted, or performed in parallel (or series) if desired. Hence, the foregoing embodiments are merely illustrative of the broader methods of the invention disclosed herein.

While the above detailed description has shown, described, and pointed out novel features of the invention as applied to various embodiments, it will be understood that various omissions, substitutions, and changes in the form and details of the device or process illustrated may be made by those skilled in the art without departing from the spirit of the invention. The foregoing description is of the best mode presently contemplated of carrying out the invention. This description is in no way meant to be limiting, but rather should be taken as illustrative of the general principles of the invention. The scope of the invention should be determined with reference to the claims.

While the invention herein disclosed has been described by means of specific embodiments and applications thereof, numerous modifications and variations could be made thereto by those skilled in the art without departing from the scope of the invention set forth in the claims.

I claim:

1. A method comprising:

depositing liquid and solid waste material into a toilet bowl;

passing the liquid and solid waste from the toilet bowl into an elongated containment chamber under the toilet bowl through a permanently unobstructed chamber inlet;

providing a high pressure flow to a high pressure nozzle pointing into the containment chamber to generate a high pressure spray into the containment chamber;

breaking up at least a portion of the solids using the high pressure spray;

propelling the liquids and the solids in the containment chamber through a chamber outlet of the containment chamber using the high pressure spray, to produce an outflow through the chamber outlet;

passing the outflow to a completing structure comprising a spiral oriented generally horizontal relative to the toilet bowl; and creating a drawing force in the completing structure to draw liquid and broken-up solid waste from the containment chamber.

2. The method of claim 1, further including a step of pre-wetting an inner surface of a toilet bowl before use to reduce or prevent sticking or staining.

3. The method of claim 1, wherein passing the outflow to a completing structure comprises passing the outflow through a completing structure including a vertical loop.

4. The method of claim 2, wherein pre-wetting the inner surface of the toilet bowl before use comprises providing a spiral spray from at least one nozzle under a rim of the toilet bowl.

5. The method of claim 2, further including initiating pre-wetting by sensing the presence of a user.

6. The method of claim 5, wherein the initiating pre-wetting comprised pre-wetting between approximately one and five seconds of operation.

7. The method of claim 5, further including skipping pre-wetting when the solid waste material is not expected.

8. The method of claim 1, wherein providing the high pressure spray comprises providing the high pressure liquid spray having a pressure range of approximately 30 pounds per square inch (PSI) to 2500 PSI.

9. The method of claim 8, wherein providing the high pressure spray comprises providing the high pressure spray having a pressure range of approximately 100 PSI and 2500 PSI.

10. The method of claim 8, wherein providing the high pressure spray comprises providing the high pressure spray between approximately two and ten seconds of operation.

11. A method for using a low volume hygienic apparatus, the method comprising:

pre-wetting an inner surface of a toilet bowl before use to reduce or prevent sticking or staining;

depositing at least one of liquid waste and solid waste material into a toilet bowl;

passing the liquid and solid waste into an elongated horizontal containment chamber below the toilet bowl through a permanently unobstructed chamber inlet;

providing a high pressure liquid flow having a pressure range of approximately 30 Pounds per Square Inch (PSI) to 2500 PSI to a high pressure nozzle pointing into the containment chamber to generate a high pressure spray into the containment chamber;

breaking up at least a portion of the solids using the high pressure spray;

propelling the liquids and the solids in the containment chamber through a chamber outlet of the containment chamber using the high pressure spray, to produce an outflow through the chamber outlet;

passing the outflow to a completing structure comprising a spiral oriented generally horizontal relative to the toilet bowl; and creating a drawing force in the completing structure to draw liquid and broken-up solid waste from the containment chamber.

12. A method for using a low volume hygienic apparatus, the method comprising:

selectively pre-wetting an inner surface of a toilet bowl using a spiral spray from at least one nozzle under a rim of the toilet bowl before use to reduce or prevent sticking or staining when solid waste material is expected;

depositing at least one of liquid waste and solid waste material into a toilet bowl;

passing the liquid and solid waste vertically through a chamber inlet at a base of the toilet bowl into an elongated horizontal containment chamber under the toilet bowl through a permanently unobstructed chamber inlet;

providing a high pressure flow having a pressure range of approximately 30 Pounds per Square Inch (PSI) to 2500 PSI to a high pressure nozzle pointing into the horizontal containment chamber along the length of the containment chamber to generate a high pressure spray into the containment chamber;

breaking up at least a portion of the solids using the high pressure spray;

propelling the liquids and the solids in the containment chamber horizontally through a chamber outlet of the containment chamber at an end of the containment chamber horizontally displaced from the chamber inlet using the high pressure spray, to produce an outflow through the chamber outlet;

passing the outflow to a completing structure comprising a spiral oriented generally horizontal relative to the toilet bowl; and creating a drawing force in the completing structure to draw liquid and broken-up solid waste from the containment chamber.

13. The method of claim 12, further including directing the generally horizontal high pressure flow into the containment chamber from opposite the chamber outlet.

14. The method of claim 13, further including aiming the high pressure spray towards the chamber outlet for urging the solid and liquid waste out of the containment chamber and into the completing structure.

15. The method of claim 14, wherein passing the liquid and solid waste into a horizontal containment chamber of the toilet bowl comprises passing the liquid and solid waste vertically into the containment chamber through a permanently unobstructed chamber inlet.

16. The method of claim 12, wherein the containment chamber has a flat generally horizontal floor and the high pressure spray is parallel to the flat floor.

17. The method of claim 11, wherein propelling the liquids and the solids in the containment chamber through a chamber outlet of the containment chamber comprises propelling the liquids and the solids in the containment chamber through the chamber outlet of an un-pressurized containment chamber.

* * * * *